US006258130B1

(12) United States Patent
Murphy

(10) Patent No.: US 6,258,130 B1
(45) Date of Patent: Jul. 10, 2001

(54) DRY-CLEANING SOLVENT AND METHOD FOR USING THE SAME

(75) Inventor: Dennis Stephen Murphy, Wyckoff, NJ (US)

(73) Assignee: Unilever Home & Personal Care, a division of Conopco, Inc., Greenwich, CT (US)

( * ) Notice: Subject to any disclaimer, the term of this patent is extended or adjusted under 35 U.S.C. 154(b) by 0 days.

(21) Appl. No.: 09/449,896

(22) Filed: Nov. 30, 1999

(51) Int. Cl.[7] ..... B08B 3/04
(52) U.S. Cl. ..... 8/142; 510/285; 510/475
(58) Field of Search ..... 428/77, 58, 306.6, 428/389, 391; 252/8.57, 8.62; 510/286, 287, 289, 285, 407, 475; 8/139.1, 142; 424/400; 427/8

(56) References Cited

U.S. PATENT DOCUMENTS 5,532,023 * 7/1996 Vogel et al. .
5,645,751 * 7/1997 Haley .
5,676,705 * 10/1997 Jureller et al. .
5,683,977 * 11/1997 Jureller et al. .
5,798,107 * 8/1998 Vogel et al. .
5,883,067 * 3/1999 Kubo et al. .
5,942,007 8/1999 Berndt et al. .
5,977,045 * 11/1999 Murphy .
6,042,617 3/2000 Berndt .
6,042,618 3/2000 Berndt et al. .
6,056,789 5/2000 Berndt et al. .
6,059,845 5/2000 Berndt et al. .
6,063,135 5/2000 Berndt et al. .
6,086,635 7/2000 Berndt et al. .

* cited by examiner

*Primary Examiner*—Necholus Ogden
*Assistant Examiner*—Gregory E. Webb
(74) *Attorney, Agent, or Firm*—Edward A. Squillante, Jr.

(57) ABSTRACT

The invention is directed to a dry-cleaning solvent and method for dry-cleaning. The dry-cleaning solvent and method employ a linear silicon comprising oligomer that unexpectedly results in excellent cleaning properties in the absence of any known environmental or health risks.

10 Claims, No Drawings

DRY-CLEANING SOLVENT AND METHOD FOR USING THE SAME

FIELD OF THE INVENTION

This invention is directed to a novel cleaning solvent. More particularly, the invention is directed to a dry-cleaning solvent comprising a linear silicon comprising oligomer, and the solvent unexpectedly results in excellent cleaning properties.

BACKGROUND OF THE INVENTION

In many cleaning applications, it is desirable to remove contaminants (e.g., stains) from substrates, like metal, ceramic, polymeric, composite, glass and textile comprising substrates. Particularly, it is highly desirable to remove contaminants from clothing whereby such contaminants include dirt, salts, food stains, oils, greases and the like.

Typically, dry-cleaning systems use organic solvents, like chlorofluorocarbons, perchloroethylene and branched hydrocarbons to remove contaminants from substrates. In response to environmental concerns, other dry-cleaning systems have been developed that use inorganic solvents such as densified carbon dioxide, to remove contaminants from substrates. The systems that use organic or inorganic solvents to remove contaminants from substrates generally employ a surfactant and a polar co-solvent so that a reverse micelle may be formed to trap the contaminant targeted for removal. Other dry-cleaning systems employ cyclic siloxanes in dry-cleaning solvents.

The use of organic solvents, however, is no longer favored since preferred organic solvents, like halogenated hydrocarbons, often lead to environmental hazards and health risks. Also, densified carbon dioxide is not always a desired solvent since machines that use such a solvent can be dangerous since they operate at very high pressures. Cyclic siloxanes, like organic solvents, are believed to be associated with environmental and health problems since studies indicate they produce liver and lung diseases in laboratory animals.

It is of increasing interest to develop cleaning solvents that do not possess environmental and safety risks. This invention, therefore, is directed to a cleaning solvent comprising a linear silicon comprising oligomer. Such a solvent unexpectedly results in excellent cleaning properties and has no known environmental and safety risks.

BACKGROUND REFERENCES

Efforts have been disclosed for cleaning clothing. In U.S. Pat. No. 4,012,194, the dry-cleaning of garments is disclosed.

Other efforts have been disclosed for cleaning garments. In U.S. Pat. No. 5,683,977, a dry-cleaning system using densified carbon dioxide and a surfactant adjunct is disclosed.

Still other efforts have been disclosed for cleaning clothing. In U.S. Pat. No. 5,942,007, dry-cleaning with cyclic siloxanes is disclosed.

Also, in U.S. Pat. No. 4,685,930, the use of cyclic siloxanes for cleaning is disclosed.

SUMMARY OF THE INVENTION

In a first aspect, this invention is directed to a cleaning solvent comprising a linear silicon comprising oligomer.

In a second aspect, this invention is directed to a dry-cleaning solvent comprising a linear silicon comprising oligomer of the formula:

(I)

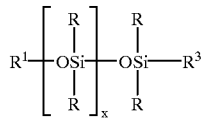

wherein each R is independently a substituted or unsubstituted linear, branched or cyclic $C_{1-10}$ alkyl, $C_{1-10}$ alkoxy, substituted or unsubstituted aryl, aryloxy, trihaloalkyl, cyanoalkyl or vinyl group, and $R^1$ is a hydrogen or a siloxy group having the formula:

$$Si(R^2)_3 \quad \text{(II)}$$

and each $R^2$ is independently a linear, branched or cyclic $C_{1-10}$ substituted or unsubstituted alky, $C_{1-10}$ alkoxy, aryloxy, substituted or unsubstituted aryl, trihaloalkyl, cyanoalkyl, vinyl group, amino, amido, ureido or oximo group, and $R^3$ is an unsubstituted or substituted linear, branched or cyclic $C_{1-10}$ alkyl, or hydrogen, hydroxy or $OSi(R^2)_3$ whereby $R^2$ is as previously defined, and x is an integer from about 0 to about 20.

In a third embodiment, this invention is directed to cleaning substrates with the above-described cleaning solvents.

DETAILED DESCRIPTION OF THE PREFERRED EMBODIMENTS

There generally is no limitation with respect to the solvent comprising the linear silicon comprising oligomer that may be used in this invention other than that the solvent may be employed to clean a substrate. Often, however, the solvent comprising the linear silicon comprising oligomer is one which may be used to dry clean clothing, and preferably, is one having the formula:

(I)

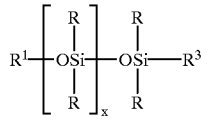

wherein each R is independently a substituted or unsubstituted linear, branched or cyclic $C_{1-10}$ alkyl, $C_{1-10}$ alkoxy, substituted or unsubstituted aryl, aryloxy, trihaloalkyl, cyanoalkyl or vinyl group, and $R^1$ is a hydrogen or a siloxy group having the formula:

$$Si(R^2)_3 \quad \text{(II)}$$

and each $R^2$ is independently a linear, branched or cyclic $C_{1-10}$ substituted or unsubstituted alkyl, $C_{1-10}$ alkoxy, aryloxy, substituted or unsubstituted aryl, trihaloalkyl, cyanoalkyl, vinyl group, amino, amido, ureido or oximo group, and $R^3$ is an unsubstituted or substituted linear, branched or cyclic $C_{1-10}$ alkyl, or hydroxy, or $OSi(R^2)_3$ whereby $R^2$ is as previously defined, and x is an integer from about 0 to about 20.

The most preferred solvent used in this invention is one wherein each R is methyl, $R^1$ is $Si(R^2)_3$, $R^2$ is methyl and $R^3$ is methyl. Preferably, x is an integer from about 0 to about 10, and most preferably, is an integer from about 2 to about 5, including all ranges subsumed therein.

The solvent comprising the linear silicon comprising oligomer that may be used in this invention is often made by equilibration of the appropriate proportions of end capped and monomer units according to the reaction: $MM+_xD \rightarrow MD_xM$. Such a reaction is generally known as a equilibration reaction, and is catalyzed by an acid or a base. Similar reactions are depicted in *Silicone Surfactants*, as edited by Randall Hill, Marcel Dekker (Vol. 96) 1999, the disclosure of which is incorporated herein by reference. Other similar descriptions of the synthesis of similar oligomers may be found in U.S. Pat. Nos. 3,931,047 and 5,410,007, the disclosures of which are incorporated herein by reference. Also, the solvents are often made commercially available by Dow Corning (e.g., Dow Corning 200 (R) fluids) and The General Electric Company.

It is noted that while the solvent comprising the linear silicon comprising oligomer may comprise of linear silicon comprising oligomer, it is also within the scope of the invention for the solvent to consist essentially of or consist of the same. Moreover, as used herein, oligomer is defined to mean a compound represented by formula I wherein x is an integer from about 0 to about 20.

When dry-cleaning clothing or garments, for example, with the cleaning solvent comprising the linear silicon comprising oligomer described in this invention, the type of machine that may be used for the dry-cleaning process is the same or substantially the same as the commonly used dry-cleaning machines used for dry-cleaning with perchloroethylene. Such machines typically comprise a solvent tank or feed, a cleaning tank, distillation tanks, a filter and solvent exit. These commonly used machines are described, for example, in U.S. Pat. No. 4,712,392, the disclosure of which is incorporated herein by reference.

Once the garment is placed in the machine and the solvent of this invention is fed into the machine, the normal cleaning cycle is run (typically between ten (10) minutes and one (1) hour) and the garment is cleaned. Thus, in order to demonstrate cleaning, it is not required to add anything to the cleaning machine other than the garment and the linear solvent of this invention.

In a preferred embodiment, however, the cleaning solvent of this invention further comprises from about 0.001% to about 5.0%, and preferably, from about 0.01% to about 1.0%, and most preferably, from about 0.1% to about 0.3% by weight of a silicone oil, based on total weight of cleaning solvent and silicone oil, including all ranges subsumed therein. The silicone oil often preferred in this invention is an alkoxylated polydimethylsiloxane with a molecular weight from about 600 to about 20,000. The silicone oil preferably has ethoxy and/or propoxy pendents, with ethoxylated pendents being especially preferred. It is also noted that such an alkoxylated polydimethylsiloxane may also have alkoxylated end functionalization; however, a silicone oil with less than 50% of all sights on the silicone oil backbone capable of being functionalized ethoxy groups is especially preferred. Illustrative examples of such silicone oils are Silwet 7622, 7602, 7605, 7600, 7230 and 7200, all of which are commercially available from Witco.

In addition to silicone oil, it is especially preferred to add from about 0.01% to about 10.0%, and preferably, from about 0.05 to about 1.0%, and most preferably, from about 0.1 to about 0.5% by weight of a polar additive (e.g., $C_{1-10}$ alcohol and preferably water), based on total weight of cleaning solvent, silicone oil and polar additive, including all ranges subsumed therein. Such an addition (silicone oil and water) to the cleaning solvent is often desired so that cleaning may be enhanced, for example, by the formation of reverse micelles.

In another preferred embodiment, it is within the scope of this invention to employ (with or without silicone oil and/or water) 0.001% to about 10%, and preferably, from about 0.05% to about 0.25%, and most preferably, from about 0.1 to about 0.20 by weight of at least one member selected from the group consisting of an unfunctionalized siloxane and a functionalized siloxane (based on total weight of cleaning solvent and unfunctionalized or functionalized siloxane), including all ranges subsumed therein.

The unfunctionalized siloxane is similar to the cleaning solvent represented by formula I, except that X is greater than 20, and the functionalized siloxane is one having a molecular weight ranging from about 300 to about 20,000. The former is commercially available from The General Electric Company and the latter is commercially available from Goldschmidt, Inc. The preferred functionalized siloxane is an amine functionalized siloxane wherein the functionalization is pendent and/or end functionalization, with less than about 50% of all sights on the siloxane backbone capable of being functionalized having amine functionalization. Such functionalized and unfunctionalized siloxanes are typically desired in this invention to act as softeners when clothing is being cleaned.

The samples which follow are provided to illustrate and facilitate an understanding of the present invention. Therefore, the examples are not meant to be limiting and modifications which fall within the scope and spirit of the claims are intended to be within the scope and spirit of the present invention.

EXAMPLE 1

A beaker was charged with 400 grams of olive oil and 25 grams of annatto seeds. The resulting mixture was stirred (about 2 hours) and heated (about 50° C.) until a resulting solution was obtained with a dark amber tint. The solution (tinted olive oil) was used to make the test stain in the Examples which follow below.

EXAMPLE 2

Sets of four (4) polyester cloths, about 5 cm×5cm, were inscribed with a pencil to form circles in the center of each cloth having diameters of about 2.5 cm. 100 microliters of the tinted olive oil from Example 1 were applied with a micropipet to the inside of the circle of each cloth. The resulting sets of stained cloths were aged overnight. The stained cloths were used in the Examples which follow below.

EXAMPLE 3

Four stained cloths prepared in Example 2 were placed in a 250 mL beaker along with 100 mL of linear silicon comprising oligomer available from Dow Corning (Dow Corning 200® Fluid, R, $R^1$ and $R^3$ of formula I as methyl, x=2, Mw about 310). The stained cloths were agitated in the oligomer, for about 15 minutes, with an IKA Labrotechnik stirrer set at 225 rpm. The resulting cleaned cloths were removed from the solvent and dried in an oven set at about 39° C.

The cleaning results were measured by placing the cleaned and dried cloths in a Hunter Reflectometer. The R scale, which measures darkness from black to white, was used to measure stain removal. The cleaning results were reported as the percent stain removal according to the following formula:

$$\% \text{ stain removal} = \frac{\text{stain removed}}{\text{stain applied}} = \frac{\text{cleaned cloth reading} - \text{stained cloth reading}}{\text{unstained cloth reading} - \text{stained cloth reading}} \times 100$$

For this experiment, 42.2% of the olive oil stain was removed.

EXAMPLE 4

The experiment of Example 4 was conducted in a manner similar to the one described in Example 3 except that Dow Corning 200® fluid (x=3 and Mw about 384) was used in lieu of the fluid having x=2 with a Mw of about 310. For this experiment, 32.3% of the olive oil stain was removed.

EXAMPLE 5

The experiment of Example 5 was conducted in a manner similar to the one described in Example 3 except that 50/50 polyester/cotton blend cloths were used in lieu of the 100% polyester cloths. For this experiment, 24.3% of the olive oil stain was removed.

EXAMPLE 6

The experiment of Example 6 was conducted in a manner similar to the one described in Example 5 except that the oligomer of Example 4 was used in lieu of the oligomer of Example 3. For this experiment, 12.9% of the olive oil stain was removed.

EXAMPLE 7

The experiment of Example 7 was conducted in a manner similar to the one described in Example 3 except that 100% cotton cloths were used in lieu of 100% polyester cloths. For this experiment, 17.2% of the olive oil stain was removed.

EXAMPLE 8

The experiment of Example 8 was conducted in a manner similar to the one described in Example 7 except that the oligomer of Example 4 was used in lieu of the oligomer of Example 3. For this experiment, 9.9% of the olive oil stain was removed.

The data in the Examples above indicates that excellent cleaning properties result when the oligomers of this invention are used in dry-cleaning, even in the absence of additional additives.

What is claimed:

1. A method for cleaning a substrate comprising the steps of:

(a) contacting the substrate with a cleaning solvent comprising a linear silicon comprising oligomer; and (b) subjecting the substrate to the cleaning solvent for one cleaning cycle, the cleaning solvent being 75% to 100% by weight linear silicon comprising oligomer.

2. The method for cleaning a substrate according to claim 1 wherein one cleaning cycle is from about ten minutes to about one hour.

3. The method for cleaning a substrate according to claim 2 wherein the cleaning solvent has the formula:

(I)

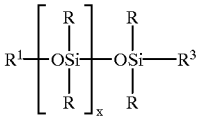

and each R is independently a substituted or unsubstituted linear, branched or cyclic $C_{1-10}$ alkyl, $C_{1-10}$ alkoxy, substituted or unsubstituted aryl, aryloxy, trihaloalkyl, Cyanoalkyl or vinyl group, and $R^1$ is a hydrogen or a siloxy group having the formula $Si(R^2)_3$, and each $R^2$ is independently a linear, branched or cyclic $C_{1-10}$ substituted or unsubstituted alkyl, $C_{1-10}$ alkoxy, aryloxy, substituted or unsubstituted aryl, trihaloalkyl, cyanoalkyl, vinyl group, amino, amido, ureido or oximo group, and $R^3$ is a substituted or unsubstituted linear, branched or cyclic $C_{1-10}$ alkyl, hydroxy or $OSi(R^2)_3$ whereby $R^2$ is as previously defined, and x is an integer from about 2 to about 20.

4. The method for cleaning a substrate according to claim 3 wherein each R is methyl, $R^1$ is $Si(R^2)_3$, $R^2$ is methyl $R^3$ is methyl and x is an integer form about 2 to about 10.

5. The method for cleaning a substrate according to claim 4 wherein x is an integer from about 2 to about 5.

6. The method for cleaning a substrate according to claim 3 wherein the dry-cleaning solvent further comprises from about 0.001 to about 5.0 percent by weight of a silicone oil.

7. The method for cleaning a substrate according to claim 6 wherein the dry-cleaning solvent further comprises from about 0.01% to about 10.0% by weight water.

8. The method for cleaning a substrate according to claim 3 wherein the dry-cleaning solvent further comprises from about 0.001% to about 10% by weight of at least one member selected from the group consisting of unfunctionalized siloxane and functionalized siloxane.

9. The method for cleaning a substrate according to claim 8 wherein the functionalized siloxane has amine functionalization.

10. The method for cleaning a substrate according to claim 1 wherein carbon dioxide is not added to the solvent.

* * * * *